US008517707B2

(12) United States Patent
Arnold

(10) Patent No.: US 8,517,707 B2
(45) Date of Patent: Aug. 27, 2013

(54) METHOD FOR CONVERTING ENERGY FROM COMPRESSED AIR INTO MECHANICAL ENERGY AND COMPRESSED AIR MOTOR THEREFOR

(75) Inventor: Felix Arnold, Neckarsteinach (DE)

(73) Assignee: Robert Bosch GmbH, Stuttgart (DE)

( * ) Notice: Subject to any disclaimer, the term of this patent is extended or adjusted under 35 U.S.C. 154(b) by 706 days.

(21) Appl. No.: 12/670,735

(22) PCT Filed: Aug. 15, 2008

(86) PCT No.: PCT/DE2008/001334

§ 371 (c)(1),
(2), (4) Date: Jan. 26, 2010

(87) PCT Pub. No.: WO2009/026883

PCT Pub. Date: Mar. 5, 2009

(65) Prior Publication Data

US 2010/0215531 A1 Aug. 26, 2010

(30) Foreign Application Priority Data

Aug. 31, 2007 (DE) ..... 10 2007 041 461

(51) Int. Cl.
*F01C 3/08* (2006.01)

(52) U.S. Cl.
USPC ..... 418/195; 418/203; 418/206.7

(58) Field of Classification Search
USPC ..... 418/195, 193, 194, 198, 200, 203, 418/206.7
See application file for complete search history.

(56) References Cited

U.S. PATENT DOCUMENTS

| | | | | |
|---|---|---|---|---|
| 1,623,596 | A * | 4/1927 | Holmes | 418/68 |
| 2,049,775 | A * | 8/1936 | Holmes | 418/68 |
| 3,236,186 | A * | 2/1966 | Wildhaber | 418/193 |
| 3,273,341 | A | 9/1966 | Wildhaber | |
| 3,464,361 | A * | 9/1969 | Voser | 418/68 |
| 3,492,974 | A * | 2/1970 | Kreimeyer | 418/53 |
| 3,788,784 | A * | 1/1974 | Zimmern | 418/153 |
| 3,817,666 | A | 6/1974 | Wildhaber | |
| 3,856,440 | A | 12/1974 | Wildhaber | |
| 4,285,644 | A * | 8/1981 | Takalo | 418/195 |
| 4,540,343 | A * | 9/1985 | Perkins | 417/218 |
| 4,981,424 | A * | 1/1991 | Bein | 418/99 |
| 5,513,969 | A | 5/1996 | Arnold | |
| 6,494,678 | B1 * | 12/2002 | Bunker | 416/97 R |
| 6,887,057 | B2 * | 5/2005 | Klassen | 418/195 |
| 7,275,920 | B2 * | 10/2007 | Arnold | 418/195 |
| 7,318,712 | B2 * | 1/2008 | Arnold | 418/195 |

(Continued)

FOREIGN PATENT DOCUMENTS

| | | |
|---|---|---|
| DE | 3117412 | 11/1982 |
| DE | 4241320 A1 | 6/1993 |

(Continued)

*Primary Examiner* — Kenneth Bomberg
*Assistant Examiner* — Dapinder Singh
(74) *Attorney, Agent, or Firm* — Michael Best & Friedrich LLP

(57) ABSTRACT

A method for converting energy from compressed air into mechanical energy, and a compressed air motor therefor. The motor includes a shaft rotor and a counterpart rotor which intermesh with each other using trochoid toothing to effect rotation of a power takeoff shaft. Compressed air is used to operate the counterpart rotor which then operates the shaft rotor thereby converting the rotation of the shaft rotor or the power takeoff rotor into mechanical rotary energy.

21 Claims, 1 Drawing Sheet

(56) References Cited

U.S. PATENT DOCUMENTS

| | | | | |
|---|---|---|---|---|
| 7,390,181 | B2 * | 6/2008 | Arnold | 418/195 |
| 7,699,592 | B2 * | 4/2010 | Arnold | 418/195 |
| 2007/0253851 | A1 | 11/2007 | Arnold | |
| 2010/0215531 | A1 * | 8/2010 | Arnold | 418/1 |

FOREIGN PATENT DOCUMENTS

| | | | |
|---|---|---|---|
| DE | 9320601 | | 10/1994 |
| WO | 9737106 | | 10/1997 |
| WO | 2005116403 | A1 | 12/2005 |

* cited by examiner

METHOD FOR CONVERTING ENERGY FROM COMPRESSED AIR INTO MECHANICAL ENERGY AND COMPRESSED AIR MOTOR THEREFOR

CROSS-REFERENCE TO RELATED APPLICATIONS

This application is a 371 application of PCT/DE2008/001334 filed on Aug. 15, 2008.

BACKGROUND OF THE INVENTION

1. Field of the Invention

The invention is based on a method for converting energy from compressed air into mechanical rotary energy and an air motor driven by compressed air as generically defined by the preamble to claim 2, in particular for performing the method of claim 1.

2. Description of the Related Art

A compressed air motor with fluidically actuated rotary drive is known, in which energy from compressed air is converted into mechanical rotary energy in that a pivoting piston subjected to compressed air converts a reciprocating pivoting motion into a rotary motion of a power takeoff shaft, using a freewheel coupling between the pivoting piston and the power takeoff shaft; the advantages of an air motor over an electric motor are emphasized (DE G 93 20 601). The rotary motion generated by compressed air in this compressed air motor, however, is disadvantageously not continuous but instead is uneven, in accordance with the motion of the pivoting piston and the use of the freewheel coupling, depending on the rotary resistance. Another disadvantage of this known pivoting piston air motor is the expensive, complicated construction and the freewheel coupling that is also required, along with the comparatively high wear to the individual motor parts that is associated with it. Moreover, the production of such a compressed air motor is extraordinarily complex, making it correspondingly expensive.

Another known compressed-air-driven drive motor, although with a revolving rotor that actuates a power takeoff shaft, has vane cells that in the manner of a vane cell assembly are pressed by springs or centrifugal force radially against the wall, as is also known in manifold ways for air compressors (German Published, Unexamined Patent Application DE OS 31 17 412 A1). The disadvantage of this type of drive is that the sealing vanes, in the direction of the revolving shaft rotor, have a perpendicular surface contact with the housing wall along which they slide, with the disadvantage that it is extremely difficult to achieve low friction and corresponding tightness here, quite aside from the disadvantages of the extremely high production costs and the problems regarding wear from sealing and lubrication, which naturally has a direct effect on the service life or on the decreasing efficiency of the compressed air motor as the length of use increases. The compressed-air-driven drive motor in this reference is furthermore supposed to be used for compressed air tools, such as sanders, in which the actual driving quality is known to be far less critical than the service life.

In still another known compressed air motor (German Published, Unexamined Patent Application DE OS 196 13 262 A1), the rotary drive of the power takeoff shaft is effected via one of two shafts, coupled via a wheel gear, that carry two rotary pistons, which in a housing by subjection to compressed air are set contrarily into a rotary motion, similar to the reversal of a Roots blower in a compressed air motor. Once again, the problem above all is sealing and wear with the attendant lack of tightness after a certain time in operation, since in radial terms the two rotary pistons each run on walls of cylinder bores or the counterpart rotor and in the axial direction in turn run with the smooth end faces on correspondingly smooth end faces of the housing, and retroactive correction for sealing purposes after wear has occurred or changes in gaps have occurred from temperature changes is not possible. Although the housing wall and the rotary piston coating are supposed to be elastic in order to compensate for this known disadvantage, this nevertheless entails corresponding effort and expense. Once again, it has been thought of that a power tool, such as a drill spindle, be driven with this kind of rotary piston concentric motor. In each case, the elastic design of such rotary pistons is subject to stringent limits, since the rotary pistons rub on the housing wall rather than rolling on it, which in an elastic intermediate region leads to a severe braking action and considerable loss of rotary forces or of torque at the power takeoff shaft of the compressed air motor.

A primary problem of compressed air motors that convert the flow energy of the compressed air into rotary energy of a shaft is the quality of this conversion, namely the extent to which one kind of energy can be converted to the other with the least possible losses. In this case, the person skilled in the art has preferred vane cell pumps, because both friction an the internal tightness of the work chambers seemed easily controlled, and above all, these fundamental characteristics that are decisive for efficiency were already known by means of pumps of this type.

One skilled in the art would not have thought that a spur geared pump could serve as a compressed air motor, since the compressed air, in the way it attacks the work faces of the motor in the work chambers, would have a compensatory action. It is true that in the industry pneumatic motors have been indicated as a possibility (German Patent DE 42 41 320 C2), but in practice, they were not built. The reasons for this were also that the known compressed air motors either have fluctuations in the rotary drive, or the requisite torques do not appear sufficient. Still another motor based on a rotary piston has also been described (U.S. Pat. No. 3,856,440) with rotary pistons that have a spur toothing; the teeth have a cycloid development of the running face, so that motor action with a power takeoff task could occur. However, no thought was given to converting energy from compressed air into mechanical rotary energy for certain purposes, nor was it described before now, and because of the frequent presence of energy from compressed air, and above all also given the fundamental need for mechanical rotary energy, this was not obvious, either. In compressed air motors, which are a reversal of pumps and compressors, one skilled in the art thinks above all of rotating parts, whose surfaces acted upon by the driving medium have a lever action in the direction of rotation with respect to the axis of rotation, an example being a vane cell device. Usually, the fact that the next vane, following the driving vane and closing off the work chamber, generates a force that partially acts counter to the direction of rotation, is usually not thought of. This adverse effect with regard to the direction of rotation also exists in the first air motor mentioned (DE G 93 20 601). In that case there are only relatively slight fluctuations in the mechanical rotary energy generated, nevertheless, given the stringent demands at present for the uniformity of the rotation quality upon conversion into mechanical rotary energy, these fluctuations are unacceptable and disadvantageous, especially in the high rpm range, such as for dental equipment.

BRIEF SUMMARY OF THE INVENTION

Because of the favorable rotary disposition in spur toothing and because of the freedom of design of the waste air opening, the present invention attains extraordinarily high efficiency; that is, high rpm limited loss of compressed air.

In accordance with the method, this assembly for converting the mechanical rotary energy can be used in a high rpm generator, of the kind that is needed not only in dentistry and in which the rotor is coupled in a manner fixed against relative rotation to the rotary piston acting as a shaft rotor.

In a definitive characteristic of the method, the work faces of the shaft rotor that along with the housing define the work chamber have a spur toothing, which is provided not only on the shaft rotor but also on a counterpart rotor cooperating with the teeth thereof and therefore toothed accordingly, whose axis of rotation has a defined angle to that of the shaft rotor yet has the same direction of rotation as the shaft rotor, and the intermeshing toothing is embodied as a trochoid toothing. To a certain extent, this specification again contradicts the assumptions of one skilled in the art, since work chambers between spur geared wheels are thought to be hardly suitable for motors, especially in the case, of trochoid toothings, in which a slight shaping of the walls of the gear wheels toward the work chamber is desired.

This is correspondingly true for the advantageous embodiment of the compressed air motor as well, in which one spur geared disk is connected to the power takeoff shaft and a second spur geared disk meshes with the first spur geared disk at a defined angle of rotation, forming the work chamber, and one of the parts, as a cycloid part, has a cycloid shaping of the running face, and as a control part, the teeth of the other part cooperating with it in meshing fashion have toothed combs, which run along the flanks of the cycloid part. As mentioned above, a rotary piston motor of this kind is known per se (DE OS 42 41 320 A1) but was never used for conversion into mechanical rotary energy. In accordance with a definitive characteristic of the present invention, at least one of the rotors is disposed on a roller bearing.

In an advantageous feature of the invention, the roller bearings provided for supporting the shaft rotor and/or the counterpart rotor are braced in the housing of the motor. Especially in pneumatically operating assemblies, smooth running is important, and here as well, the lubrication of the bearing represents a not inconsiderable problem, which is possibly another cause for the prejudice of the professional field.

In a feature of the invention that is advantageous in this respect, the roller bearing is supported in the housing by a support nut, which can be screwed in the direction of the axis of rotation, and is axially adjustable with the rotor in the housing. As a result, at least one calibration of the rotors can be done in the housing or relative to one another.

In an advantageous feature of the invention, the inlet conduit is distributed over a defined angle of rotation and is embodied as narrower but widening in the direction of rotation, toward the work chamber in accordance with the narrow opening formed on the pressure side between the rotors.

In an additional advantageous feature of the invention, the outlet conduit is distributed over a defined angle of rotation and embodied as comparatively wide for the sake of dismantling in accordance with the wide-open work chamber at this point toward the outlet conduit. In this case, the work chamber can be open toward the outside, since the energy input to the compressed air has already been used.

DETAILED DESCRIPTION OF THE INVENTION

Figure 1:
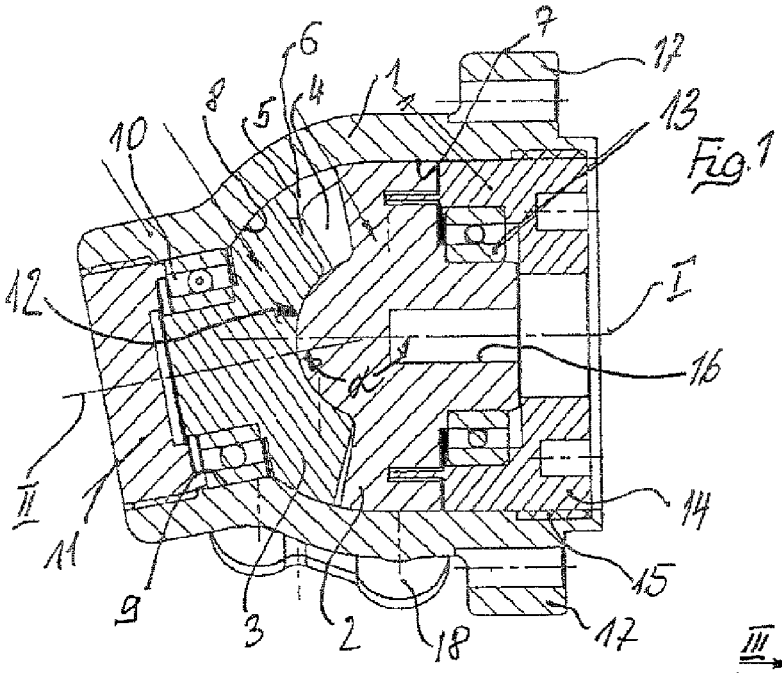
FIG. 1 is a longitudinal section along the axes of rotation I and II of a compressed air motor with spur gear toothing.

In the motor shown in longitudinal section in FIG. 1 and driven by compressed air, in a housing 1, two rotors acting as rotary pistons are supported, namely one shaft rotor 2 and one counterpart rotor 3, which mesh with one another with teeth 4 and 5 disposed on their face ends and in so doing with the housing 1 define motor work chambers 6. The axis of rotation of the shaft rotor 2 is marked I and the axis of rotation of the counterpart rotor 3 is marked II. The two axes of rotation I and II form an angle $\alpha<180°$, so that upon rotation of the rotors 2 and 3, the motor work chambers 6 correspondingly increase and decrease in size, respectively. The longitudinal section shown in FIG. 1 through the air motor passes through these two axes of rotation I and II.

On the inside, for receiving the rotors, the housing 1 has a cylindrical portion 7 and a spherical portion 8, and the latter changes over into a cylindrical portion 9 for receiving the bearing of the counterpart rotor 3 and correspondingly its offset center axis II. The counterpart rotor 3 is rotationally supported on a roller bearing 10, which is disposed in the cylindrical portion 9 of the housing 1, fastened by means of a support stopper 11. The support stopper 11 is screwed into the housing 1 for the sake of fastening the roller bearing 10.

Between the rotors, to enable the pendulum motion between the rotors that results upon rotation because of the angle $\alpha$ between the axes of rotation I and II, a spherical contact face 12 is provided, which also simultaneously divides the motor work chambers 6 from one another that are formed by the radial teeth 4 and 5 of the rotors. In the radial teeth 4 and 5, a cycloid toothing is provided, with the known advantages thereof (German Patent DE PS 42 41 320 C2). The shaft rotor 2 forming the actual performance part is likewise rotationally supported on a roller bearing 13, which itself is supported by a motor work chamber 14, which is guided on one side in the cylindrical portion 7 of the housing 1 but on the other is screwed into the housing 1 there via a thread 15. As a result, on the one hand, easy rotary motion of the shaft rotor 2 is assured, and on the other, a certain calibratability is assured, including relative to the spherical portion 8 or the counterpart rotor 3. The shaft rotor 2 furthermore has a coupling opening 16, for receiving a rotary coupling, not shown, for transmitting the rotary motion. A flange 17 is disposed on the housing 1 in order to make it possible correspondingly to secure a assembly that is to be driven. A flange 18 is also provided on the back side of the housing 1, for attaching the compressed air inlet to a motor work chamber that at this point is still small.

Figure 2:
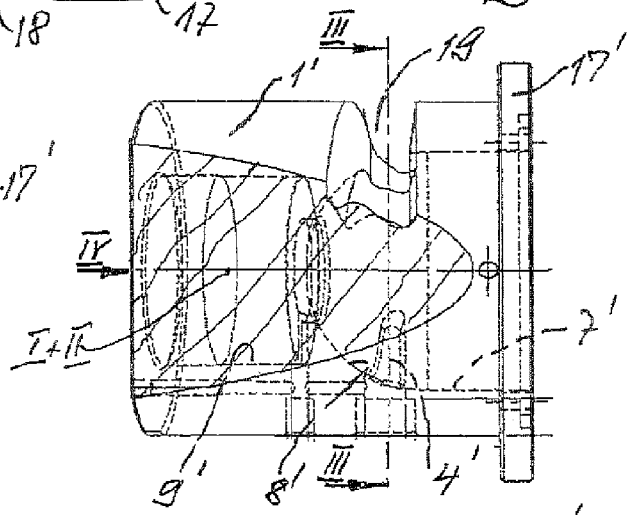
FIG. 2 is a fragmentary section through a variant of the pump housing in a position rotated by 90° relative to FIG. 1.
Figure 3:
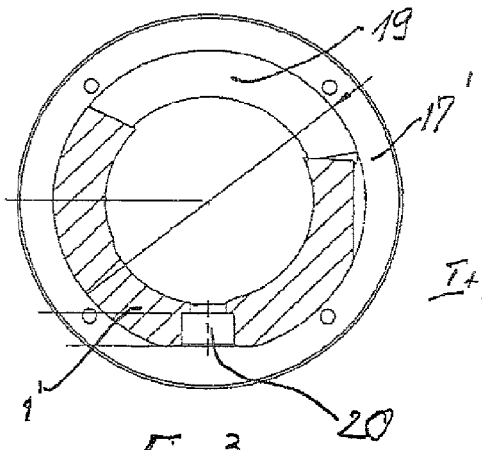
FIG. 3 is a section along the line III-III in FIG. 2 and on a somewhat reduced scale.
Figure 4:
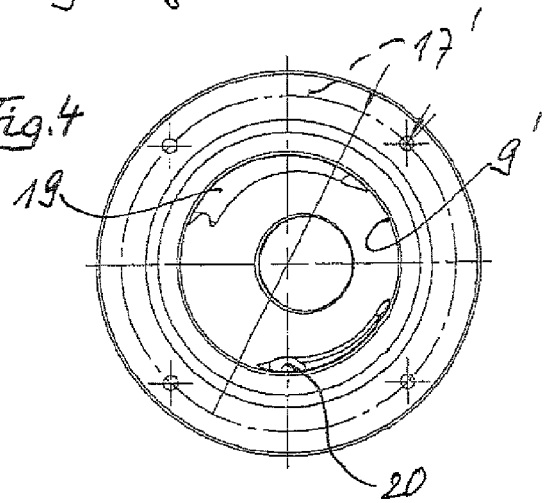
FIG. 4 is a view into the housing in the direction of the arrow IV in FIG. 2, again on a slightly reduced scale.

In the variant of the air motor shown in FIGS. 2 through 4, the housing is on the one hand shown rotated by 90° relative to the section shown in FIG. 1 and on the other is also embodied cylindrically over its entire length. As a result, the axes of rotation I and II coincide in this view, which is apparent only in perspective but can also be seen in FIG. 4. Items that correspond to those in FIG. 1 are provided with the same reference numerals as in FIG. 1, differing in having a prime. However, only one housing is shown as a variant; the section shown in FIG. 2 is intended to serve the purpose of clearly illustrating the outlet opening 19 after the compressed air has been fully utilized, or in other words after its depressurization.

Thus as shown in FIG. 3, a connection bore 20 for letting the compressed air into the pump work chamber 4, which is not shown here but opposite at this point is small, is provided in the housing 1 on the compressed air side. On the opposite side in the housing 1, a correspondingly large outlet opening 19 is provided, in order to attain an actual depressurization of the compressed air. By means of the invention, it is attained that with air delivered under pressure to a simple trochoidally spur-toothed rotary piston and by means of the depressurization of this air, a shaft rotor which in turn acts as a motor is driven.

All the characteristics represented in the specification, recited in the ensuing claims and shown in the drawings, can be essential to the invention both individually and in arbitrary combination with one another.

LIST OF REFERENCE NUMERALS

1 Housing
2 Shaft rotor
3 Counterpart rotor
4 Radial teeth
5 Radial teeth
6 Motor work chamber
7 Cylindrical portion
8 Spherical portion
9 Cylindrical portion for 3
10 Roller bearing
11 Support stopper
12 Contact face
13 Roller bearing
14 Support nut
15 Thread
16 Coupling opening
17 Flange
18 Flange inlet connection
19 Outlet opening
20 connection bore
Variant in FIGS. 2 through 4
I Axis of rotation of FIG. 2
II Axis of rotation of FIG. 3
$\alpha$Angle

The invention claimed is:

1. A compressed air motor for converting energy from compressed air into mechanical rotary energy, said compressed air motor comprising:

a shaft rotor driven by compressed air and operating as a rotary piston, a counterpart rotor, a single piece housing receiving the shaft rotor and the counterpart rotor, the single piece housing, shaft rotor, and counterpart rotor defining a motor work chamber, the single piece housing having an interior surface engaged with both the shaft rotor and counterpart rotor, the single piece housing having a first open end and a second open end, a support stopper positioned in the first open end, and a support nut positioned in the second open end, an inlet connection and an outlet conduit of the motor work chamber for the compressed air or for depressurized waste air, the shaft rotor configured to be coupled to a drive shaft of an assembly that generates mechanical rotary energy, the shaft rotor having a trochoid toothing which cooperates with the counterpart rotor, said counterpart rotor meshing with the trochoid toothing and driving the shaft rotor, each of the shaft rotor and the counterpart rotor having an axis of rotation, the axis of rotation of the shaft rotor forming an angle other than 180° with the axis of rotation of the counterpart rotor thereby causing a corresponding increase or decrease in the volume of the motor work chamber with a corresponding relief of air pressure, and a first roller bearing, at least one of the rotors being supported by the first roller bearing.

2. The compressed air motor as defined by claim 1, wherein the shaft rotor is supported by said first roller bearing and said first roller bearing is supported by the support nut which is secured to the single piece housing.

3. The compressed air motor as defined by claim 2, wherein the counterpart rotor is supported on a second roller bearing which is disposed in the single piece housing, said second roller bearing being supported by the support stopper that closes the single piece housing.

4. The compressed air motor as defined by claim 3, wherein one of the roller bearings is axially adjustable in the single piece housing along one of the axes of rotation.

5. The compressed air motor as defined by claim 4, wherein said single piece housing has an inlet conduit and said inlet conduit opens into the work chamber.

6. The compressed air motor as defined by claim 5, wherein the work chamber transitions into the outlet conduit, which is disposed in the single piece housing and has a large cross section that makes complete depressurization of the compressed air possible.

7. The compressed air motor as defined by claim 1, wherein the counterpart rotor and the shaft rotor contact each other at a spherical contact face.

8. The compressed air motor as defined by claim 1, wherein the single piece housing has a spherical portion and a cylindrical portion.

9. A method for converting energy from compressed air into mechanical rotary energy using a compressed-air-driven assembly, said method comprising the steps of providing a compressed air motor having a single piece housing, a shaft rotor, and a counterpart rotor, the single piece housing receiving the shaft rotor and the counterpart rotor, the single piece housing, shaft rotor, and counterpart rotor defining a work chamber, the single piece housing having an interior surface engaged with both the shaft rotor, the single piece housing having a first open end and a second open end, a support stopper positioned in the first open end, and a support nut positioned in the second open end, providing the shaft rotor and the counterpart rotor with intermeshed trochoid toothing, directing compressed air into the single piece housing to operate the motor, thereby effecting rotation of a power takeoff shaft and converting rotation of the shaft rotor or of the power takeoff shaft into mechanical rotary energy.

10. The method of claim 9, wherein the method further comprises the step of using the compressed air to cause the counterpart rotor to operate.

11. The method of claim 10, wherein the method further comprises the step of using the counterpart rotor to cause the shaft rotor to operate.

12. The method of claim 11, wherein the method further comprises the step of providing the single piece housing with a spherical portion and a cylindrical portion.

13. The method of claim 12, wherein the method further comprises the step of providing roller bearings for supporting one of the rotors.

14. The method of claim 12, wherein the method further comprises the step of providing roller bearings for supporting both of the rotors.

15. A compressed air motor for converting energy from compressed air into mechanical rotary energy, said compressed air motor comprising:

a shaft rotor driven by compressed air and operating as a rotary piston;

a counterpart rotor, a single piece housing receiving the shaft rotor and the counterpart rotor, the single piece housing, shaft rotor, and counterpart rotor defining a motor work chamber, an inlet connection and an outlet conduit of the motor work chamber for the compressed air or for depressurized waste air, a roller bearing supporting one of the shaft rotor and the counterpart rotor, wherein the shaft rotor is configured to be coupled to a drive shaft of an assembly that generates mechanical rotary energy, wherein the shaft rotor has a trochoid toothing which cooperates with the counterpart rotor, the counterpart rotor meshing with the trochoid toothing and driving the shaft rotor, and wherein each of the shaft rotor and the counterpart rotor has an axis of rotation, the axis of rotation of the shaft rotor forming an angle other than 180° with the axis of rotation of the counterpart rotor thereby causing a corresponding increase or decrease in the volume of the motor work chamber with a corresponding relief of air pressure, at least one of the shaft rotor, the counterpart rotor and the roller bearing being axially adjustable relative the single piece housing along one of the axes of rotations.

16. The compressed air motor as defined by claim 15, wherein the shaft rotor is supported by the first roller bearing and the first roller bearing is supported by a support nut which is secured to the single piece housing.

17. The compressed air motor as defined by claim 16, wherein the counterpart rotor is supported on a second roller bearing which is disposed in the single piece housing, the second roller bearing being supported by a support stopper that closes the single piece housing.

18. The compressed air motor as defined by claim 17, wherein both the first roller bearing and second roller bearing are axially adjustable relative the single piece housing along at least one of the axes of rotation.

19. The compressed air motor as defined by claim 15, wherein a threaded stopper or support nut is attached to the single piece housing, and at least one of the shaft rotor, the counterpart rotor and the roller bearing are axially adjustable via the threaded stopper or support nut.

20. A method for converting energy from compressed air into mechanical rotary energy using a compressed-air-driven assembly, said method comprising:

providing a compressed air motor including a shaft rotor, a counterpart rotor, a roller bearing and a single piece housing receiving the shaft rotor the counterpart rotor and the roller bearing, the roller bearing supporting at least one of the shaft rotor and the counterpart rotor, the single piece housing, the shaft rotor, and the counterpart rotor defining a work chamber;

providing intermeshed trochoid toothing on the shaft rotor and the counterpart rotor;

directing compressed air into the single piece housing to operate the motor, thereby effecting rotation of a power takeoff shaft and converting rotation of one of the shaft rotor and the power takeoff shaft into mechanical rotary energy; and adjusting at least one of the shaft rotor, the counterpart rotor, and the roller bearing axially relative to the housing along an axis of rotation of the shaft or counterpart rotor.

21. The method of claim 19, further comprising adjusting a second roller bearing axially relative the housing, the second roller bearing supporting at least one of the rotors.

* * * * *